US005250766A

United States Patent [19]

Hikita et al.

[11] Patent Number: 5,250,766

[45] Date of Patent: Oct. 5, 1993

[54] ELEVATOR CONTROL APPARATUS USING NEURAL NETWORK TO PREDICT CAR DIRECTION REVERSAL FLOOR

[75] Inventors: Shiro Hikita, Hyogo; Shintaro Tsuji, Aichi, both of Japan

[73] Assignee: Mitsubishi Denki Kabushiki Kaisha, Tokyo, Japan

[21] Appl. No.: 705,070

[22] Filed: May 23, 1991

[30] Foreign Application Priority Data

May 24, 1990 [JP] Japan ..... 2-132470

[51] Int. Cl.[5] ..... B66B 3/00

[52] U.S. Cl. ..... 187/133; 187/127; 187/130

[58] Field of Search ..... 187/124, 127, 133, 130; 364/138, 513; 381/43

[56] References Cited

U.S. PATENT DOCUMENTS

| | | | |
|---|---|---|---|
| 4,536,842 | 8/1985 | Yoneda et al. | 187/133 |
| 4,672,531 | 6/1987 | Uetani | 187/124 |
| 5,020,642 | 6/1991 | Tsuji | 187/124 |
| 5,022,498 | 6/1991 | Sasaki et al. | 187/127 |
| 5,040,215 | 8/1991 | Amano et al. | 381/43 |
| 5,046,019 | 9/1991 | Basehore | 364/513 |

FOREIGN PATENT DOCUMENTS

| | | |
|---|---|---|
| 2086081 | 9/1981 | United Kingdom . |
| 2222275 | 2/1990 | United Kingdom . |
| 2235312 | 6/1990 | United Kingdom . |
| 2237663 | 10/1990 | United Kingdom . |

OTHER PUBLICATIONS

"Collective Computation in Neuronlike Circuits"; Scientific American; vol. 257, pp. 104–108; Dec. 1987.

"Chips for the Nineties and Beyond"; Byte; pp. 342–346; Nov. 1990.

"Design of a Neural-Based A/D Converter Using Modified Hopfield Network"; IEEE Journal of Solid-State Circuits, vol. 24, No. 4, pp. 1129–1135; Aug. 1989.

"Computers that Learn"; Aerospace America; Jun. 1988.

"Designing Computers that Think the Way We Do"; Technology Review; May/Jun. 1987.

"Brain Wave Hits Japanese Computers"; New Scientist; Nov. 26, 1986.

*Primary Examiner*—Steven L. Stephan
*Assistant Examiner*—Robert Nappi
*Attorney, Agent, or Firm*—Leydig, Voit & Mayer

[57] ABSTRACT

An elevator control apparatus capable of predicting reversion floors of elevator cages accurately. The control apparatus comprises a neural network, in which traffic state data are fetched into the neural network, so that predicted values of floors where the moving direction of each cage is reversed are calculated as predicted reversion floors. In the elevator control apparatus, reversion floors near true reversion floors can be predicted flexibly correspondingly to traffic state and traffic volume.

28 Claims, 8 Drawing Sheets

10DA1, 10DB1 : INPUT LAYER
10DA2, 10DB2 : INTERMEDIATE LAYER
10DA3, 10DB3 : OUTPUT LAYER
wa1 (i, j), wa2 (j, k), wb1 (i, j), wb2 (j, k) : WEIGHING COEFFICIENTS

ELEVATOR CONTROL APPARATUS USING NEURAL NETWORK TO PREDICT CAR DIRECTION REVERSAL FLOOR

BACKGROUND OF THE INVENTION

The present invention relates to an elevator control apparatus in which reversion floors of elevator cages can be predicted accurately.

Heretofore, a group control operation has been generally employed in an elevator apparatus having a plurality of cages provided side by side. As an example of the group control operation, there is an assignment system. The assignment system is such that an estimated value for each cage is calculated immediately after registration of a landing-place call, and a cage having the best estimated value is selected as an assigned cage to perform service so that only the assigned cage is made to respond to the landing-place call, thereby improving running efficiency and shortening the waiting time. In the calculation of such an estimated value, in general, predicted waiting time for the landing-place call has been used. For example, in an elevator group-control apparatus described in Published Examined Japanese Patent Application No. Sho-58-48464, the sum of the squares of all values of predicted waiting time for all landing-place calls is calculated as an estimated value for each cage on the assumption that the landing-place calls are temporarily assigned to the respective cages when the landing- place calls are registered, by which a cage having the minimum estimated value is selected as an assigned cage.

In this case, the predicted waiting time is calculated by adding the landing-place call duration (the time elapsed after a landing-place call was registered) to the predicted arrival time (the time required for the car to move from the present position to the floor where the landing-place call has been issued).

The waiting time for the landing-place call can be shortened (in particular, the long waiting time of a minute or more can be reduced) by using the estimated value thus obtained.

If the predicted arrival time is not accurate, the estimated value cannot have the meaning of a reference value for selection of the assigned cage so that the waiting time for the landing- place call cannot be shortened. Accordingly, the accuracy of the predicted arrival time has a great influence on the performance of the group control.

In the following, conventional predicted arrival time calculation methods are described specifically. The predicted arrival time is calculated in such a manner (A) as follows on the assumption that the cage makes a reciprocating motion between two end floors.

(A) The time required for running (running time) is calculated from the distance between the cage position and the target floor, the time required for stopping (stop time) is calculated from the number of stops at intermediate floors between the cage position and the target floor, and the predicted arrival time is calculated by adding the running time to the stop time (Refer to Published Examined Japanese Patent Application No. Sho-54-20742 and Published Examined Japanese Patent Application No. Sho-54-34978).

To improve the accuracy in prediction of the stop time at the cage-position floor and the stop-expected floors, the following prediction methods (B)-(E) have been proposed. (B) Correction is made on the predicted arrival time in accordance with the cage state (in the deceleration, in the door- opening operation, in the opened-door state, in the door-closing operation, in the running state, etc.) at the floor where the cage is present (Refer to Published Examined Japanese Patent Application No. Sho-57-40074).

(C) The number of passengers getting on and the number of passengers getting off at each stop-expected floor are detected by using a detection or prediction device, and correction is made on the predicted arrival time in accordance with the number of those passengers (Refer to Published Examined Japanese Patent Application No. Sho-57-40072 and Published Unexamined Japanese Patent Application No. Sho-58-162472).

(D) Correction is made on the predicted arrival time on the consideration of the fact that the time required for passengers to enter and exit a cage varies depending on whether the stop-expected floor is selected due to a cage call or to a landing place call (Refer to Published Examined Japanese Patent Application No. Sho-57-40072).

(E) The stop time at each floor is predicted on the basis of statistical data obtained by measuring the true stop time door- opening time, passenger-entry and exit time and door-closing time) at each floor or on the basis of door open time obtained by simulation and built in the group controller (Refer to Published Unexamined Japanese Patent Application No. Hei-1-275382 and Published Unexamined Japanese Patent Application No. Sho-59-138579).

To improve the predicted arrival time on the consideration of the possibility that a call will be registered in the future to stop the cage at a stop-unexpected floor, the following methods (F)-(H) have been proposed further.

(F) The number of cage calls to be produced by the stopping of the cage to respond to a landing-place call at intermediate floors is predicted on the basis of statistical data pertaining to the number of passengers in the past, and the predicted number of cage calls is distributed to the forward floors on the basis of the statistical probability distribution of cage calls which occurred in the past to thereby predict the stop time due to the derivative cage calls (Refer to Published Examined Japanese Patent Application No. Sho-63-34111).

(G) The probability of stopping of the cage at each floor and at each cage direction is calculated on the basis of the number of times of cage direction reversal and the measured value of the number of passengers in each cage direction in the past, and correction is made on the predicted arrival time on the basis of the result of the above calculation (Refer to Published Unexamined Japanese Patent Application No. Sho-59-26872).

(H) The stop time due to the cage call at each floor is predicted on the basis of the floor getting-off rate calculated for each floor and for each direction (Refer to Published Examined Japanese Patent Application No. Sho-63-64383).

As described above, it is general in the prior art that the predicted arrival time is calculated on the assumption that the cage makes a reciprocating motion between the two end floors. However, in most cases, the direction of the movement of the cage is reversed at an intermediate floor by maximum call reversion or minimum call reversion. There arises a problem in that an error is produced between the predicted arrival time and the true arrival time.

To solve this problem, a method of calculating the elevator service predicted time has been proposed as described in Published Examined Japanese Patent Application No. Sho-54-16293. In the calculation method, the running time to a call floor at a greatest distance in the direction of the movement of the cage and the running time to a call floor in the reverse direction therefrom are calculated to calculate the predicted arrival time. According to the calculation method, a floor URF (upper reversion floor) where the direction of the cage is reversed at the maximum call and a floor LRF (lower reversion floor) where the direction of the movement of the cage is reversed at the minimum call are set respectively to the uppermost floor among the cage call or landing-place call floors and to the lowermost floor among the cage call or landing place call floors.

However, it has been found that the aforementioned upper and lower reversion floor setting method has still a problem in the point of accuracy in the predicted arrival time. This point will be described with reference to FIG. 8.

In the drawing, the reference numeral (1) designates an elevator cage which is operated between the 1st floor and the 12th floor. The reference numeral (8*c*) designates a cage call at the 8th floor, (7*d*) and (9*d*) respectively designate downward landing-place calls at the 7th and 9th floors, and (7*u*) and (9*u*) respectively designate upward landing-place calls at the 7th and 9th floors.

The upper reversion floor URF in each of conditions (a)-(f) in FIG. 8 is set to the uppermost floor among the cage call or landing-place call floors. That is, as shown in the drawing, URF is set to 8F, 9F, 9F, 8F, 9F and 9F in the conditions (a)-(f) respectively.

In each of the conditions (c) and (f), however, the upper reversion floor URF is set to the 9th floor 9F of the upward landing-place call (9*u*) though it can be sufficiently expected that a new cage call may be registered at a floor above 9F after the cage (1) has responded to the upward landing-place call (9*u*) at 9F. In this case, it is irrational that the upper reversion floor URF is set to 9F. That is, in this case, the upper reversion floor ought to be set to any floor of 10F or higher.

Considering cage calls derived when response is made to the upward landing-place call (7*u*) at 7F, in the condition (d), it is similarly obvious that error with respect to the predicted arrival time becomes large when the upper reversion floor URF in the condition (d) is set to 8F. Also in each of the conditions (a) and (b), the possibility that the upper reversion floor URF may be shifted more upward by assigning a new landing-place call to the upward moving cage is sufficiently considered according to the traffic circumstances.

In general, the predicted reversion floor is used for prediction of in-cage crowdedness, prediction of near-future cage position, prediction of cage settlement, etc. as well as it is used for calculation of the predicted arrival time to carry out the dispersive waiting operation of a plurality of cages, the assignment operation for landing-place calls, etc. Accordingly, accuracy in prediction of the reversion floor has a great influence on accuracy in other various kinds of prediction.

Further, a group-control controller for selecting a cage assigned a landing-place call on the basis of calculation using a neural network imitating the neuron of the human brain has been proposed as described in Published Unexamined Japanese Patent Application No. Hei-1-275381. However, there is no consideration of improvement in accuracy in calculation of the predicted arrival time and accuracy in calculation of the predicted in-cage crowdedness.

As described above, the conventional elevator control apparatuses have a problem in that reversion floors can not be predicted so accurately that a large error with respect to the predicted arrival time is produced, because there is no consideration of the possibility that calls will occur in the near future.

SUMMARY OF THE INVENTION

Accordingly, an object of the present invention is therefore to provide an elevator control apparatus in which reversion floors near the true reversion floors can be predicted flexibly corresponding to traffic state and traffic volume to thereby solve the aforementioned problem in the prior art.

The elevator control apparatus according to the present invention comprises: an input data conversion means for converting traffic state data including elevator cage positions, cage running directions, and calls to be responded, into data in the form usable as input data to a neural network; a reversion floor prediction means constituting said neural network and including an input layer for receiving said input data, an output layer for outputting, as output data, data corresponding to predicted reversion floors at which said elevator cages are predicted to reverse their moving directions, and an intermediate layer disposed between said input layer and said output layer and having weighing coefficients; and an output data conversion means for converting said output data into data in the form usable for a predetermined control operation.

The elevator control apparatus according to another aspect of the present invention further comprises: a learning data forming means for storing not only the predicted reversion floors of said cages together with the input data at the time of prediction but the true reversion floors obtained by detecting floors where the moving directions of said cages are actually reversed, at a predetermined point of time in a running period of the elevator, to thereby send out the stored input data, the predicted reversion floors and the true reversion floors as a set of learning data; and a correction means for correcting the weighing coefficients of said reversion floor prediction means by using said learning data forming means.

According to the present invention, traffic state data are fetched into the neural network, so that predicted values of floors where the moving direction of each cage is reversed are calculated as predicted reversion floors.

According to another aspect of the present invention, the weighing coefficients in the neural network are corrected automatically on the basis of the result of the predictive calculation, the traffic state data used therein and the measured data.

BRIEF DESCRIPTION OF THE DRAWINGS

In the accompanying drawings.

DESCRIPTION OF THE PREFERRED EMBODIMENTS

Figure 1:
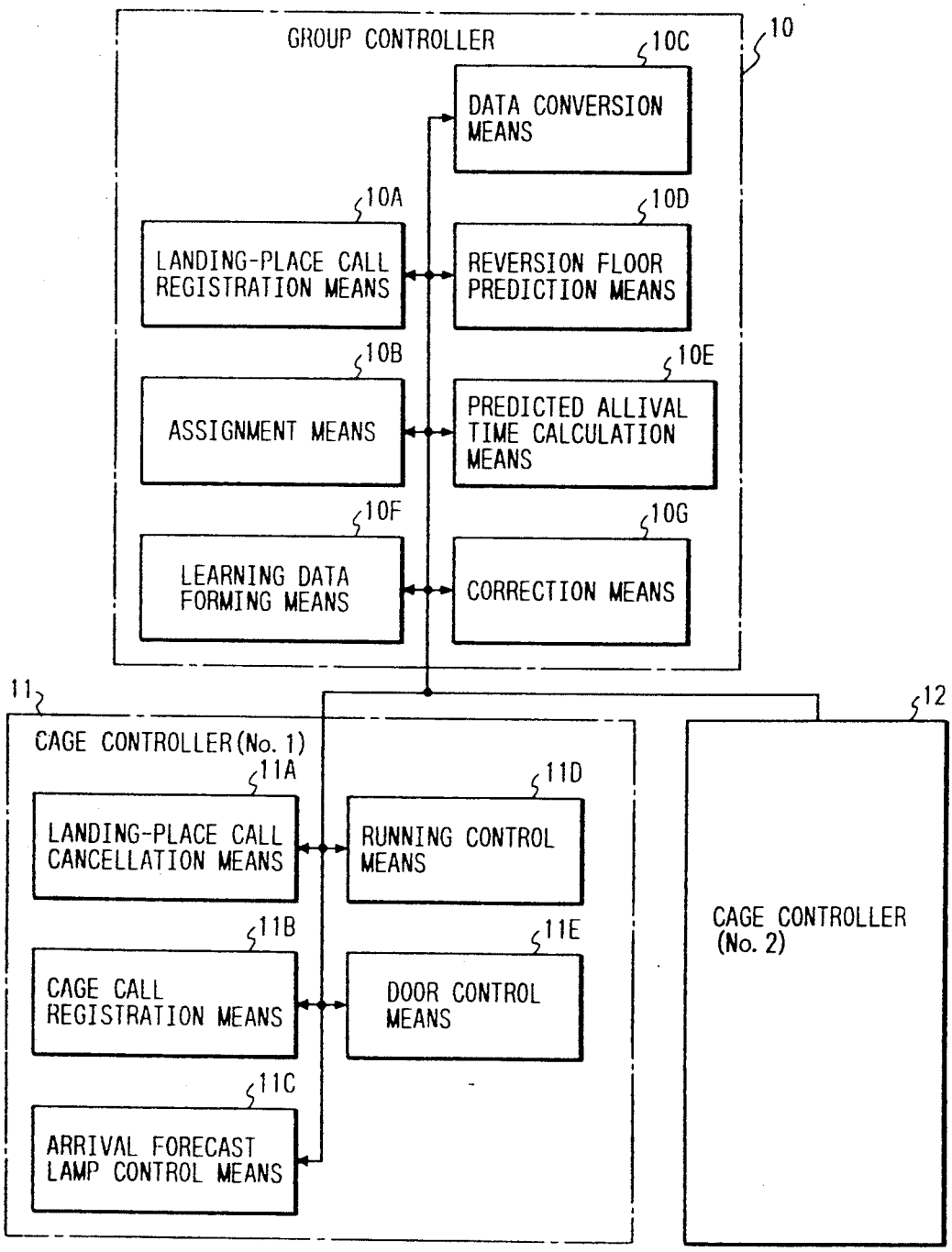
FIG. 1 is a functional block diagram showing the whole configuration of embodiments of the present invention.
Figure 2:
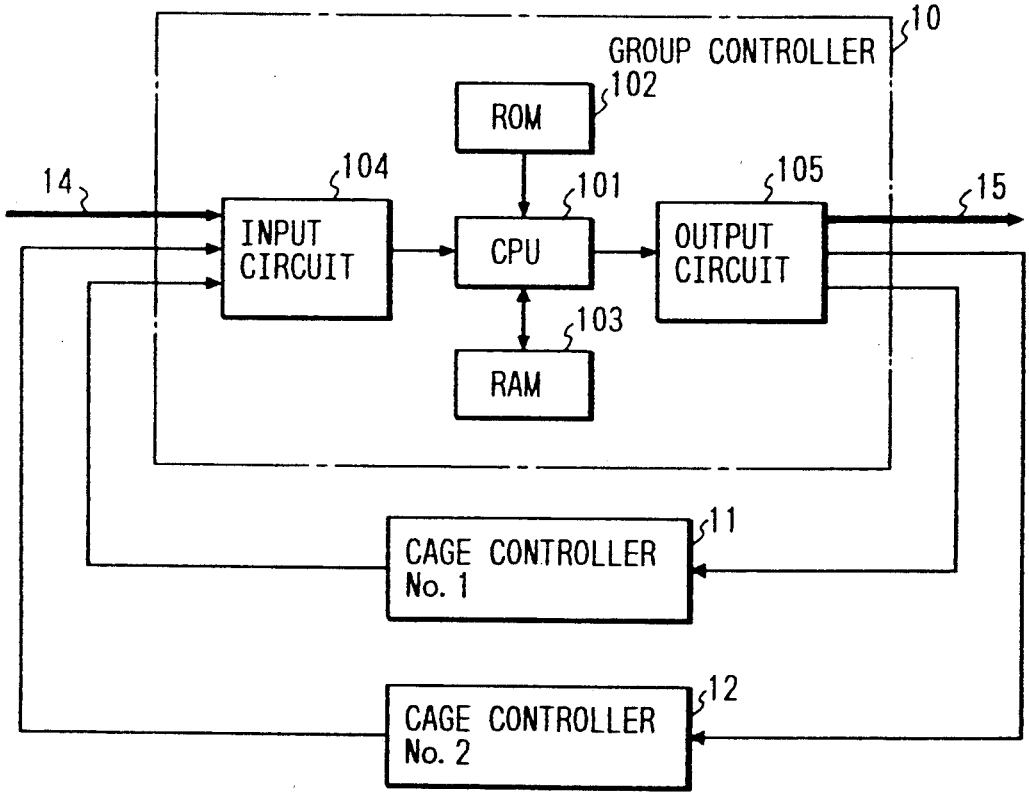
FIG. 2 is a block diagram showing the schematic configuration of the group controller depicted in FIG. 1.

An embodiment of the present invention will be described below with reference to the drawings. FIG. 1 is a functional block diagram showing the whole configuration of an embodiment of the present invention; and FIG. 2 is a block diagram showing the schematic configuration of the group controller depicted in FIG. 1.

In FIG. 1, the group controller (10) functionally comprises the following means (10A)–(10G) for controlling a plurality (for example, No. 1 and No. 2) of cage controllers (11) and (12).

The landing-place call registration means (10A) registers/cancels landing-place calls (up calls and down calls at landing places) on respective floors and also calculates the time elapsed (that is, the time of duration) after the registration of those landing-place calls.

The assignment means (10B) for assigning an optimum cage a service to a landing-place call, for example, predictively calculates the waiting time required for response of respective cages to landing-place calls on respective floors and then assigns a cage having the minimum value in the sum of the squares of the calculated values.

The data conversion means (10C) includes an input data conversion means for converting traffic state data such as data of elevator cage positions, data of cage running directions, and data of calls to be responded (cage calls, or assigned landing- place calls), etc. into data in the form which can be used as neural-network input data, and an output data conversion means for converting neural-network output data (predicted values of reversion floors) into data in the form which can be used for the control calculation of predicted arrival time and the like.

The reversion floor prediction means (10D) for predictively calculating the upper reversion floors and lower reversion floors of respective cages by using a neural network, as will be described later, includes a neural network composed of an input layer for receiving input data, an output layer for sending out data corresponding to the predicted reversion floors as output data, and an intermediate layer disposed between the input layer and the output layer and set with weighing coefficients.

The predicted arrival time calculation means (10E) calculates the predicted values (that is, predicted arrival time) of the time required for the arrival of respective cages to the landing place in respective directions, on the basis of the predicted reversion floors.

The learning data forming means (10F) stores traffic state data before input conversion (or after input conversion) and measured data (or teacher data) related to the reversion floors of respective cages after that and sends out the data as learning data. Accordingly, teacher data are stored as a part of the learning data in the learning data forming means (10F).

The correction means (10G) learns and corrects the function of the neural network in the reversion floor prediction means (10D) by using the learning data.

The No. 1 and No. 2 cage controllers (11) and (12) are the same in configuration. For example, the No. 1 cage controller (11) is constituted by known means (11A-)–(11E) as follows.

The landing-place call cancellation means (11A) sends out landing-place call cancellation signals for landing-place calls on respective floors. The cage call registration means (11B) registers cage calls on respective floors. The arrival forecast lamp control means (11C) controls the lighting of arrival forecast lamps (not shown) on respective floors. The running control means (11D) controls the running and stopping of the cage to determine the running direction of the cage and make the cage respond to the cage calls and the assigned landing-place calls. The door control means (11E) controls the opening and shutting of the entrance/exit door of the cage.

In FIG. 2, the group controller (10) is constituted by a known microcomputer composed of an MPU (microprocessing unit) or CPU (101), an ROM (102), an RAM (103), an input circuit (104), and an output circuit (105).

The input circuit (104) receives landing-place button signals (14) from landing places on respective floors and No. 1 and No. 2 status signals from the cage controllers (11) and (12). The output circuit (105) sends out landing-place button lamp signals (15) to landing-place button lamps included in respective landing-place buttons and command signals to the cage controllers (11) and (12).

Figure 3:
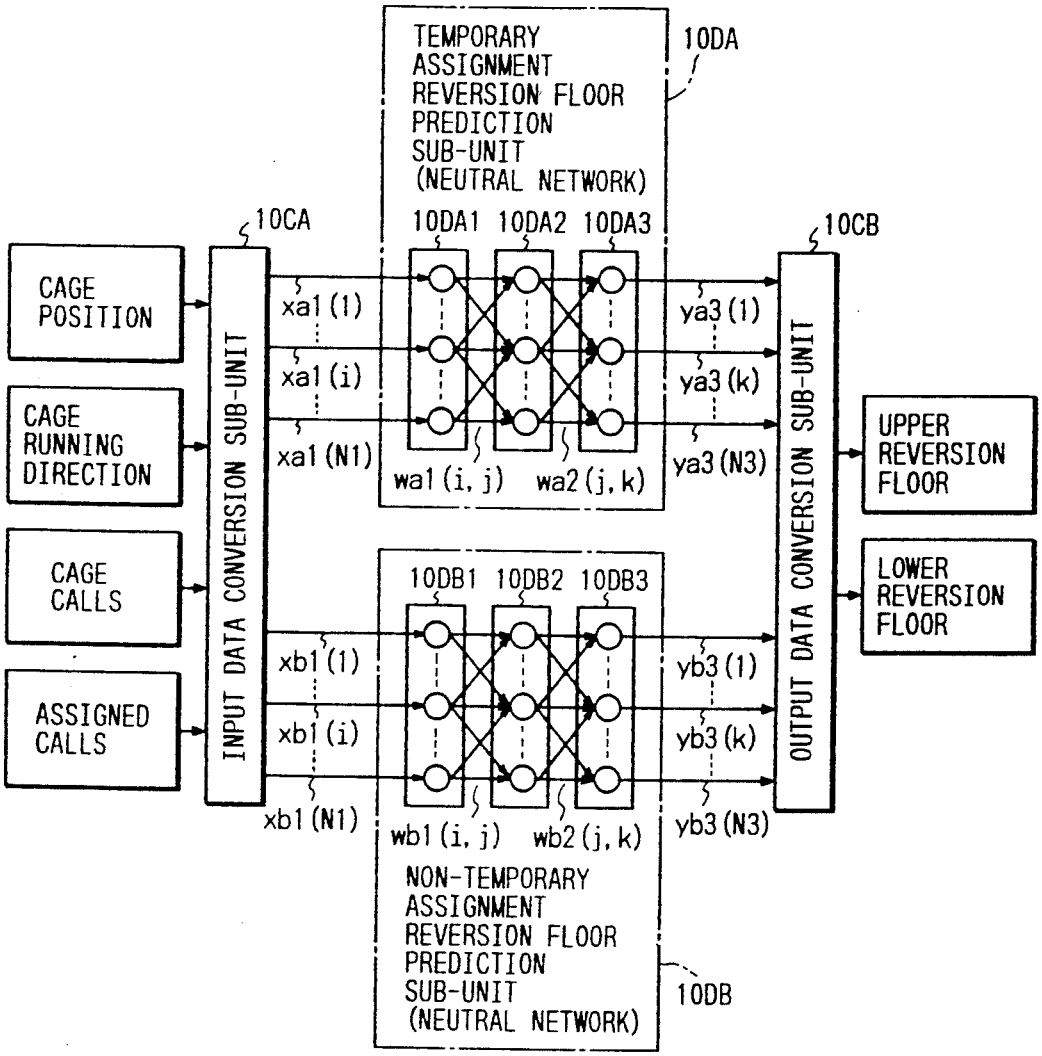
FIG. 3 is a block diagram showing the detailed configuration of the data conversion means and the reversion floor prediction means depicted in FIG. 1.

FIG. 3 is a functional block diagram showing the specific relationship between the data conversion means (10C) and the reversion floor prediction means (10D) depicted in FIG. 1.

In FIG. 3, an input data conversion means, that is, an input data conversion sub-unit (10CA), and an output data conversion means, that is, an output data conversion sub-unit (10CB), constitute the data conversion means (10C) depicted in FIG. 1. A temporary assignment reversion floor prediction sub-unit (10DA) and a non-temporary assignment reversion floor prediction sub- unit (10DB) which are disposed between the input data conversion sub-unit (10CA) and the output data conversion sub-unit (10CB) and each of which is constituted by a neutral network, constitute the reversion floor prediction means (10D) depicted in FIG. 1.

The input data conversion sub-unit (10CA) converts traffic state data such as cage positions, cage running directions, and calls to be responded, that is, cage calls and assigned landing- place calls (assigned calls) to be responded, etc. into data in the form which can be used as input data for the neural networks (10DA) and (10DB). The output data conversion sub-unit (10CB) converts output data (predicted values of reversion floors) of the neural networks (10DA) and (10DB) into data in the form which can be used for the calculation of predicted arrival time, that is, into values for indicating the upper/lower reversion floors.

The neural network (10DA) is composed of an input layer (10DA1) for receiving input data from the input data conversion sub-unit (10CA), an output layer (10DA3) for sending out data corresponding to the predicted reversion floors as output data, and an intermediate layer (10DA2) disposed between the input layer (10DA1) and the output layer (10DA3) and set with weighing coefficients.

Similarly, the neural network (10DB) includes an input layer (10DB1), an intermediate layer (10DB2), and an output layer (10DB3).

The layers (10DA1)–(10DA3) of the neural network (10DA) are connected to each other through a network and the layers (10DB1)–(10DB3) of the neural network (10DB) are connected to each other through another network, each network being constituted by a plurality of nodes. In FIG. 3, shown are three nodes for each neural network for the purpose of simplification. Assuming now that the number of nodes in the input, intermediate and output layers are respectively represented by N1, N2 and N3, then the number of nodes N3 in each of the output layers (10DA3) and (10DB3) can be represented by the formula:

$$N_3=2\times FL$$

in which FL represents the number of floors in a building. On the other hand, the number of N1 in each of the input layers (10DA1) and (10DB1) connected to the input data conversion subunit (10CA) and the number of nodes N2 in each of the intermediate layers (10DA2) and (10DB2) can be determined on the basis of the number of floors FL in the building, the kind of input data used, the number of cages, etc.

Of N1 input values xa1(1)–xa1(N1), the i-th input value xa1(i) is inputted into the i-th node of the input layer (10DA1) in the neural network (10DA). Of N3 output values ya3(1)–ya3(N3), the k-th output value ya3(k) is outputted from the k-th node of the output layer (10DA3) in the neural network (10DA). Here, i and k are integers represented by i=1,2, - - - N1 and k=1,2, - - - N3. Though not shown for the purpose of avoiding complication, the output values from the input layer (10DA1), the input values to the intermediate layer (10DA2), the output values from the intermediate layer (10DA2), and the input values to the output layer (10DA3) are represented by ya1(1)–ya1(N1), xa2(1)–xa2(N2), ya2(1)–ya2(N2), and xa3(1) xa3(N3), respectively, and the input value to the j-th node (j=1,2, - - - N2) of the intermediate layer (10DA2) and the output value therefrom are represented by xa2(j) and ya2(j), respectively.

In the neural network (10DA), weighing coefficients for the respective input values are set between the input layer (10DA1) and the intermediate layer (10DA2) and between the intermediate layer (10DA2) and the output layer (10DA3) For example, weighing coefficients wa1(i,j) and wa2(j,k) are set between the i-th node of the input layer and the j-th node of the intermediate layer and between the j-th node of the intermediate layer and the k-th node of the output layer, respectively. Here, the coefficients wa1(i,j) and wa2(j,k) satisfy the following relations.

$$0\leqq wa1(i,j)\leqq 1$$

$$0\leqq wa2(j,k)\leqq 1$$

Similarly, in the neural network (10DB), the input values to the input layer (10DB1) and the output values from the output layer (10DB3) are represented by xb1(1)–xb1(N1) and yb3(1)–yb3(N3), respectively. Further, weighing coefficients between the input layer and the intermediate layer and between the intermediate layer and the output layer are represented by wb1(i,j) and wb2(j,k), respectively. The coefficients wb1(i,j) and wb2(j,k) satisfy the following relations.

$$0\leqq wb1(i,j)\leqq 1$$

$$0\leqq wb2(j,k)\leqq 1$$

Figure 4:
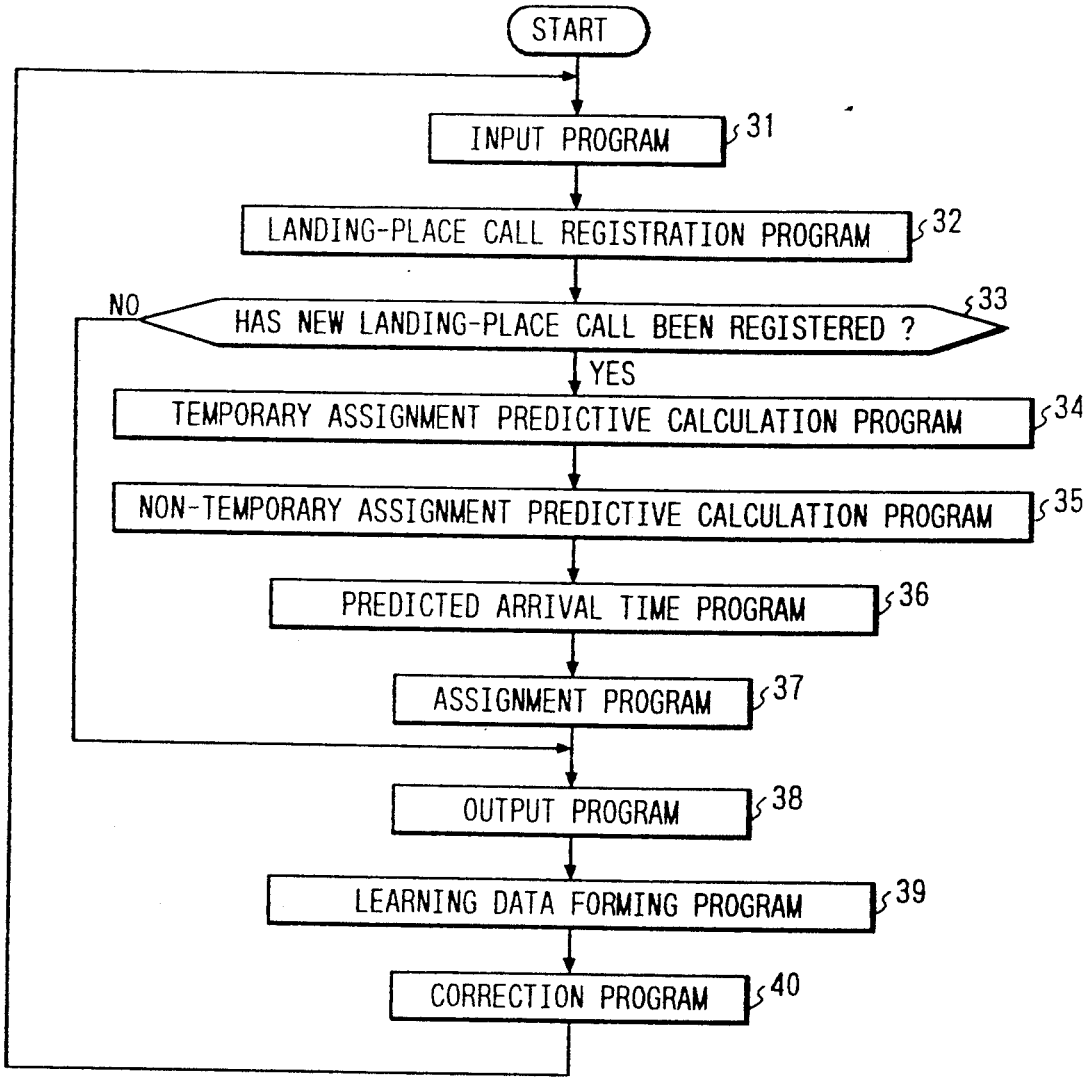
FIG. 4 is a flow chart showing the schematic configuration of group control programs stored in the ROM depicted in FIG. 2.
Figure 5:
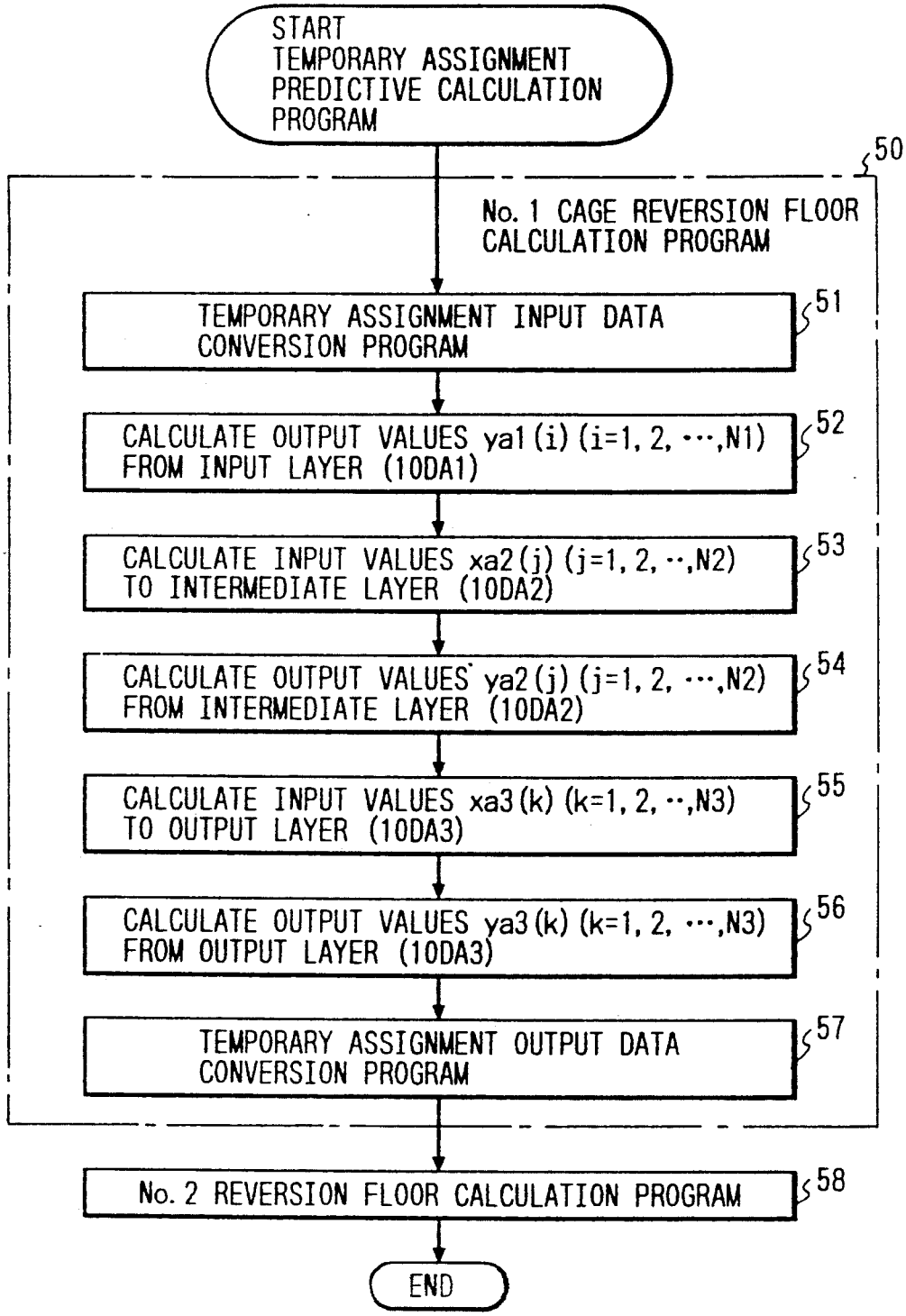
FIG. 5 is a flow chart showing the detailed configuration of the temporary assignment predictive calculation program depicted in FIG. 4.
Figure 6:
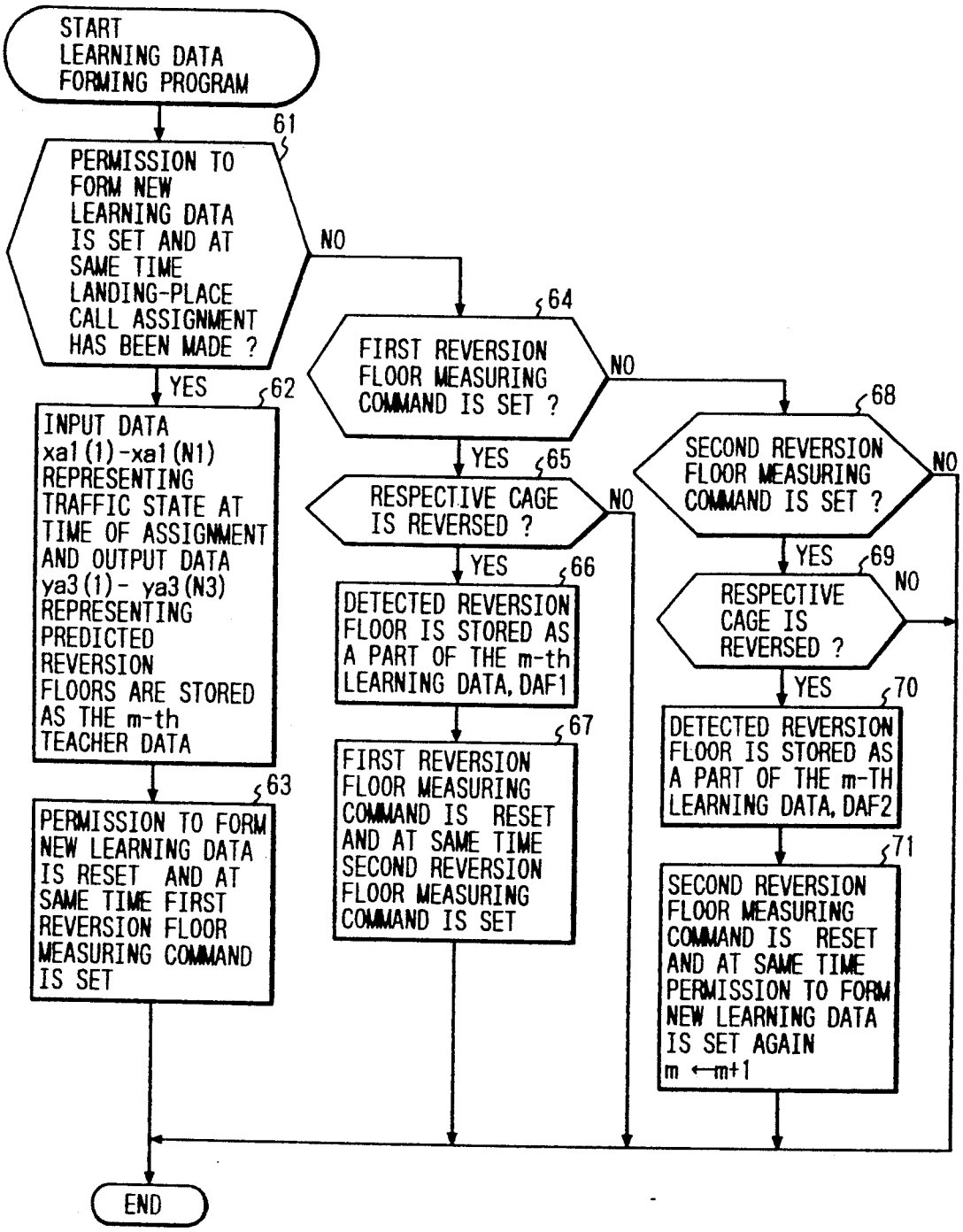
FIG. 6 is a flow chart showing the detailed configuration of the learning data forming program depicted in FIG. 4.
Figure 7:
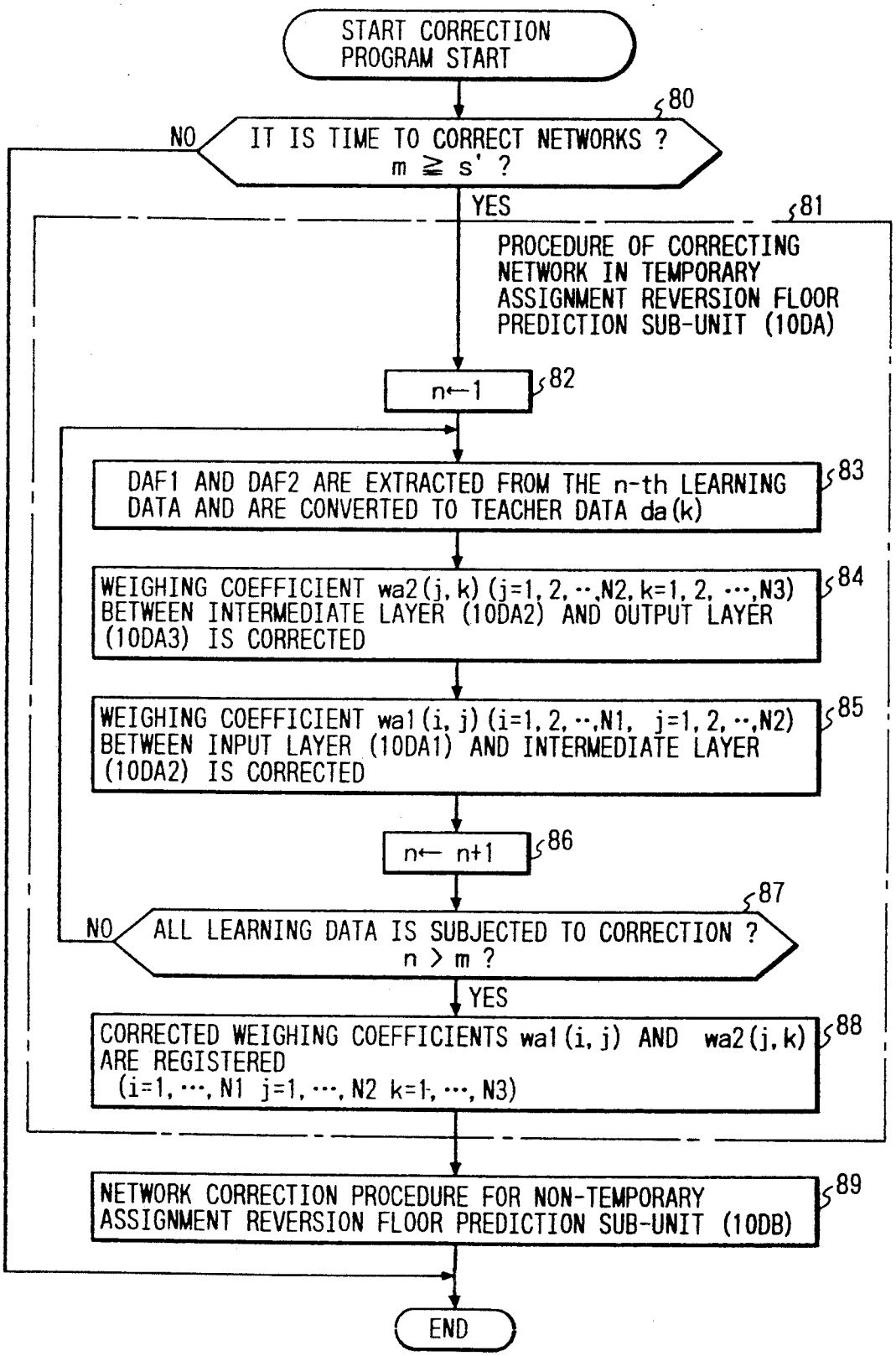
FIG. 7 is a flow chart showing the detailed configuration of the correction program depicted in FIG. 4.
Figure 8:
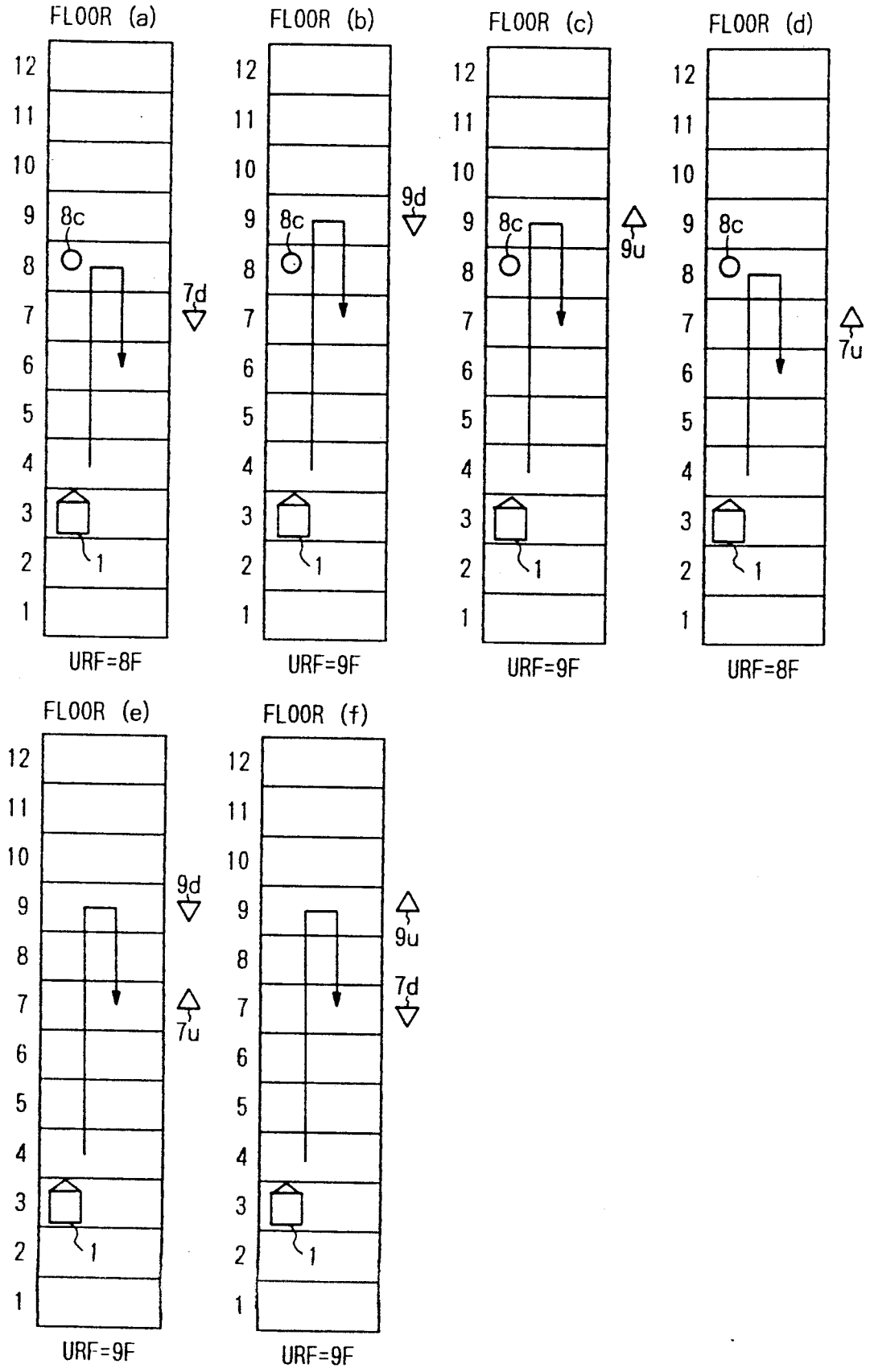
FIG. 8 PRIOR ART
FIG. 8 is an explanatory view showing the relation of reversion floors with respect to cage position and call position in a conventional elevator control apparatus.

FIG. 4 is a flow chart schematically showing a series of group control programs stored in the ROM (102) in the group controller (10); FIG. 5 is a flow chart showing the specific configuration of the temporary assignment predictive calculation program depicted in FIG. 4; FIG. 6 is a flow chart showing the specific configuration of the learning data forming program depicted in FIG. 4; and FIG. 7 is a flow chart showing the specific configuration of the correction program depicted in FIG. 4.

The outline of the group control operation of an embodiment of the present invention as shown in FIGS. 1 through 3 will be described below with reference to FIG. 4.

First, the group controller (10) fetches landing-place button signals (14) and status signals from the cage controllers (11) and (12) according to a known input program (the step 31). The status signals inputted herein include a cage position signal, a running direction signal, a stopping/running state signal, a door opened/closed state signal, a cage load signal, a cage call signal, a landing-place-call cancellation signal, etc.

Then, the registration/cancellation of landing-place calls, the judgment of the turning on/off of landing-place button lamps and the calculation of the duration of the landing-place calls are carried out according to a known landing-place call registration program (the step 31).

Then, a judgment (the step 33) is made as to whether a new landing-place call has been registered or not. If it has been registered, a temporary assignment predictive calculation program (the step 34), a non-temporary assignment predictive calculation program (the step 35), a predicted arrival time program (the step 36) and an assignment program (the step 37) are executed.

When a new landing-place call (as represented by C) has been registered, the programs of the steps 34 through 37 are executed as follows Estimated values $W_1$ and $W_2$ of waiting time are calculated under the assumption that the landing-place call C is temporarily successively assigned to the No. 1 and No. 2 cages. One of the cages which has the smallest estimated value is selected as a properly assigned cage. An assignment command and a forecast command corresponding to the landing-place call C are issued for the assigned cage.

That is, in the temporary assignment predictive calculation program (the step 34), the upper reversion floor URFA(1) and the lower reversion floor LRFA(1) of the No. 1 cage and the upper reversion floor URFA(2) and the lower reversion floor LRFA(2) of the No. 2 cage are predictively calculated under the assumption that the new landing-place call C is temporarily successively assigned to the No. 1 and No. 2 cages. Assuming now that the floor where an elevator is first reversed is called "first reversion floor" and that the floor where the elevator is next reversed is called "second reversion floor", then the upper reversion floor and the lower reversion floor respectively become the first reversion floor and the second reversion floor in the case where it is predicted that the elevator is running upward or will start upward soon. The predictive calculation operation in the step 34 will be now described in detail with reference to FIG. 5.

In FIG. 5, the No. 1 cage reversion floor calculation program (the step 50) includes the following the steps 51 through 57.

According to the temporary assignment input data conversion program (the step 51), data (a cage position, a running direction, cage calls, assigned landing-place calls) pertaining to the No. 1 cage to be subjected to prediction of the reversion floor are extracted from the input traffic state data and converted into the form of input data to the respective nodes of the network in the input layer (10DA1) of the temporary assignment reversion floor prediction sub-unit (10DA).

For example, the cage state (input value to the first node) xa1(1) that "this elevator is now at the first floor F1" is represented by the formula:

$$xa1(1)=F1/FL$$

in which FL represents the number of floors in the building. That is, the cage state xa1(1) is represented by a value statistically normalized in a range of 0 to 1. Similarly, the cage running direction (input value to the second node) xa1(2) is represented as follows: upward direction "+1"; downward direction "−1"; and no direction "0". When the landing-place call is temporarily assigned to a cage having no direction, the direction to the landing-place must be set as the running direction. Each of the cage calls (input values to the 3rd–14th nodes) xa1(3)–xa1(14) for the 1st–12th floors is represented as follows: registration "1"; and no registration "0". Each of the up assignment landing-place calls (input values to the 15th–25th nodes) xa1(15)–xa1(25) for the 1st–11th floors is represented as follows: assignment "1"; and no assignment "0". Each of the down assignment landing-place call (input values to the 26th–36th nodes) xa1(26)–xa1(36) is represented as follows: assignment "1"; and no assignment "0".

After input data to the input layer (10DA1) are set as described above, the steps 52–56 perform the network calculation to predict the reversion floor under the assumption that the new landing-place call C is temporarily assigned to the No. 1 cage.

That is, output values ya1(i) (i=1,2,—,N1) from the input layer (10DA1) are first calculated on the basis of the input data xa1(i) by the following formula (the step 52).

$$ya1(i)=1/[1+exp\{-xa1(i)\}] \quad (1)$$

Then, input values xa2(j) (j=1,2,—,N2) to the intermediate layer (10DA2) are calculated by adding, with respect to i=1—N1, the values obtained by multiplying the output values ya1(j) of the formula (1), respectively by weighing coefficients wa1(i,j), that is, input values xa2(j) are calculated by the following formula (the step 53).

$$xa2(j)=\Sigma\{wa1(i,j)\ x\ ya1(i)\} \quad (2)$$

(i=1—N1)

Then, output values ya2(j) from the intermediate layer (10DA2) are calculated on the basis of the input values xa2(j) of the formula -" by the following formula (the step 54).

$$ya2(j)=1/[1+exp\{-xa2(j)\}] \quad (3)$$

Then, input values xa3(k) (k=1,2,—,N3) to the output layer (10DA3) are calculated by adding, with respect to j=1—N2, the values obtained by multiplying the output values ya2(j) of the formula (3) respectively by weighing coefficients wa2(j,k), that is, input values xa3(k) are calculated by the following formula (the step 55).

$$xa3(k)=\Sigma\{wa2(j,k)x\ ya2(j)\} \quad (4)$$

(j=1—N2)

Then, output values ya3(k) from the output layer (10DA3) are calculated on the basis of the input values xa3(k) of the formula (4) by the following formula (the step 56).

$$ya3(k)=1/[1+exp\{-xa3(k)\}] \quad (5)$$

After the network calculation for predicting the inversion floor under the assumption that the new landing-place call C is temporarily assigned to the No. 1 cage is finished as described above, the predicted reversion floor is finally decided on the basis of the temporary assignment output data conversion program (the step 57).

As described preliminarily, the number of nodes N3 in the output layer (10DA3) of the neural network (10DA) is represented by the following formula.

$$N3=2\times FL$$

These nodes are established so that one node corresponds to one floor. Output values from the 1st - FL-th nodes equivalent to a half part of the all nodes are used for predictively determining the first reversion floor. Output values from the (FL+1)-th−N3(=2FL)-th nodes equivalent are used for predictively determining the second reversion floor.

For example, the first reversion floor calculated under the assumption that the new landing-place call C is temporarily assigned to the No. 1 cage is determined to be a floor CRA1 satisfying the following formula (6).

$$ya3(CRA1)=max\{ya3(1),\ ---,\ ya3(FL)\} \quad (6)$$

The formula (6) represents that a floor corresponding to the node having the maximum output value among the 1st - FL-th nodes of the output layer (10DA3) is determined to the first reversion floor at the time of assignment.

Similarly, the second reversion floor CRA2 is calculated according to the following formula (7).

$$ya3(CRA2)=max\{ya3(FL+1),\ ---,ya3(N3)\} \quad (7)$$

Of the reversion floors CRA1 and CRA2 calculated according to the formulae (6) and (7), the larger one is used as the upper reversion floor URFA(1) at the time of temporary assignment and smaller one as the lower reversion floor LRFA(1). That is, the reversion floors are represented by the following formulae.

$$URFA(1)=max\{CRA1,CRA2\} \quad (8)$$

$$LRFA(1)=min\{CRA1,CRA2\} \quad (9)$$

By the aforementioned steps 52 - 57, the upper reversion floor URFA(1) and the lower reversion floor LRFA(1) pertaining to the No. 1 cage at the time of temporary assignment are calculated, so that the No. 1 cage reversion floor calculation program (the step 50) is terminated.

Thereafter, the upper reversion floor URFA(2) and the lower reversion floor LRFA(2) pertaining to the No. 2 cage at the time of temporary assignment are calculated by the same reversion calculation program (the step 39) as described above.

Returning to FIG. 4, in the non-temporary assignment predictive calculation program (the step 35), the upper reversion floors URFB(1) and URFB(2) and the lower reversion floors LRFB(1) and LRFB(2) pertaining to the No. 1 and No. 2 cages in the case where the new landing-place call C is assigned to neither No. 1 cage nor No. 2 cage are calculated. This step 35 is similar to the step 34, except that they are different in data pertaining to the new landing-place call C among the input data.

As described above, the predicted values of reversion floors of the No. 1 and No. 2 cages are found by the data conversion means (10C) and the reversion floor prediction means (10D) according to the steps 34 and 35 depicted in FIG. 4.

Then, the predicted arrival time calculation means (10E) calculates, according to the predicted arrival time calculation program (the step 36), predicted arrival time A1(f) to each landing place f at the time of temporary assignment of the newly registered landing-place call C to the No. 1 cage (which corresponds to the landing-place call under the consideration of the upward/downward direction), predicted arrival time A2(f) to each landing place f at the time of temporary assignment of the newly registered landing-place call C to the No. 2 cage and predicted arrival time B1(f) and B2(f) of the No. 1 and No. 2 cages at the time of assignment to neither No. 1 nor No. 2.

Assuming now that the number FL of floors is 12, then the landing-place number f=1,2,—,11 represents the upward landing place on each of the floors 1st, 2nd,—, 11th and the landing- place number f=12,13, - - - ,22 represents the downward landing place on each of the floors 12th, 11th, - - - , 2nd.

For example, the predicted arrival time is calculated on the assumption that each cage takes 2 seconds to move by one floor and takes 10 seconds to stop at each floor and that each cage successively makes a round of landing places between the predicted upper reversion floors URFA(1), URFA(2), URFB(1) and URFB(2) and the predicted lower reversion floors LRFA(1), LRFA(2), LRFB(1) and LRFB(2). Further, the predicted arrival time to landing places above the upper reversion floor is calculated while each landing place is regarded as an upper reversion floor. The predicted arrival time to landing places lower than the lower reversion floor is calculated while each landing place is regarded as a lower reversion floor. Further, in the case of a no-direction cage, the predicted arrival time is calculated on the assumption that the cage goes directly to each landing place from the cage-position floor.

These values of predicted arrival time are used in the assignment program (the step 37) for calculating the estimated values $W_1$ and $W_2$ of waiting time.

Then, in the output program (the step 38), the output circuit (105) sends the aforementioned set landing-place button lamp signals (15) to respective landing places and sends command signals including assignment signals, forecast signals, standby signals, etc. to the cage controllers (11) and (12).

The aforementioned reversion floor predicting method is a method for determining the predicted reversion floor by network calculation according to the formulae (1) to (9) with the traffic state such as respective cage running states, landing-place call states, etc. as input signals. The network used herein represents a causal relation between the traffic state and the reversion floor. The network changes according to the weighing coefficients wa1(i,j) and wa2(j,k) pertaining to the connections between nodes contained in the respective sub-units, that is, neural networks (10DA) and (10DB). Accordingly, more suitable predicted reversion floors can be determined by suitably changing the weighing coefficients wa1(i,j) and wa2(j,k) on the basis of learning.

Another embodiment of the invention using a learning data forming means (10F) and a correction means (10G) will be described below.

In this embodiment, the learning (that is, network correction) is carried out efficiently by using a back propagation method. The back propagation method is a technique for correcting the weighing coefficients pertaining to network connection by using error between output data from the network and desired output data (teacher data) formed from measured data.

First, in the learning data forming program (the step 39) in FIG. 4, the traffic state data before input data conversion (or after conversion) and the measured data pertaining to the reversion floors of each cage after that are stored and sent out as learning data.

In the following, the learning data forming operation is described more in detail with reference to FIG. 6.

A judgment is made as to whether permission to form new learning data is set and at the same time as a judgement as to whether landing-place call assignment is made (the step 61).

If permission to form learning data is set and at the same time landing-place call assignment has bee made, input data xa1(1)–xa1(N1) representing the traffic state at the time of assignment and output data ya3(1)–ya3(N3) representing the predicted reversion floors are stored as the m-th teacher data (that is, a part of learning data) (the step 62) Then, permission to form new learning data is reset and at the same time a first reversion floor measuring command is set (the step 63).

As a result, in the step 61 in the next calculation period, a decision is made that permission to form new learning data is not set. Accordingly, the procedure passes to step 64. In the step 64, a judgment is made as to whether the first reversion floor measuring command is set or not. Because the measuring command has been set in the step 63, if so then the procedure passes to step 65 to judge whether the respective cage is reversed or not.

When reversion is then detected in a certain calculation period, the procedure passes to step 66 to store the detected reversion floor as a part of the m-th learning data element. This is a crude teacher data which is represented by the first reversion floor DAF1. Then, in the step 67, the first reversion floor measuring command is reset and at the same time a second reversion floor measuring command is set.

In the calculation period after that, a decision is made that the first reversion floor measuring command is not set. Accordingly, the procedure passes from step 61 to step 68 through step 64.

In step 68, a judgment is made as to whether the second reversion floor measuring command is set or not. Because the measuring command has been set in the step 67, the procedure passes to step 69 to judge whether the respective cage is reversed or not.

When reversion is detected in a certain calculation period, the procedure passes from step 69 to the step 70 to store the detected reversion floor as a part of the m-th learning data. This is a crude teacher data element which is represented by the second reversion floor DAF2. Then, in step 71, the second reversion floor measuring command is reset and at the same time permission to form new learning data is set again while the learning data number m is increased.

Learning data are repeatedly formed in the same manner as described above in synchronism with landing-place call assignment and are stored in the learning data forming means (10F).

The learning data are formed separately for each cage assigned for the landing-place call and for each cage not assigned for the landing-place call. The learning data for the former cage (assigned cage) are used for correcting the network in the temporary assignment reversion floor prediction sub-unit (10DA). The learning data for the latter cage (non-assigned cage) are used for correcting the network in the non-temporary assignment reversion floor prediction sub-unit (10DB).

Then, the correction means (10G) corrects the networks of the neural networks (10DA) and (10DB) by using the learning data in the correction program (the step 40) in FIG. 4.

In the following, the correcting operation is described more in detail with reference to FIG. 7.

First, a judgment is made as to whether or not it is the appropriate time to correct the networks (the step 80). When it is the time to correct the networks, the procedure (the step 81) of correcting the network in the temporary assignment reversion floor prediction sub-unit (10DA) which is composed of the following steps 82–88 is carried out and then the procedure (the step 89) of correcting the network in the other sub-unit (10DB) is carried out in the same manner. The point of time when the number m of learning data sets currently stored reaches S (for example, 100) is not regarded as the network correction time. The reference number S for the judgment of learning data can be determined suitably according to the network scale such as the number of set elevators, the number FL of floors in the building, the number of landing-place calls, etc.

In the case where a decision is made in the step 80 that the number m of learning data sets is equal to S or more and then the procedure passes to step 81, learning data counter number n is initialized to 1 (the step 82).

Then, the first reversion floor DAF1 and the second reversion floor DAF2 are extracted from the n-th learning data. At the same time, learning data having the values of nodes corresponding to the floors as "1" and the values of nodes corresponding to the other floors as "0" are regarded as teacher data da(k) (the step 83).

Here, the teacher data da(k) satisfy the following formulae.

$$da(DAF1)=1$$

$$da(DAF2+FL)=1$$

Further, the teacher data da(k) satisfy the following formula for k (k=1,2,—,N3) satisfying k≠DF1 or k≠DAF2+FL.

$$da(k)=0$$

Then, error Ea between the output values ya3(-1)–ya3(N3) of the output layer (10DA3) extracted from the n-th learning data and the teacher data da(1) da(N3) is calculated by adding the squares of the differences therebetween for k=1—N3, that is, error Ea is calculated according to the following formula.

$$Ea=\Sigma[\{da(k)-ya3(k)\}^2]/2 \quad (11)$$

(k=1 - - - N3)

Further, the weighing coefficient wa2(j,k) (j=1,2,—,N2, k=1,2,—,N3) between the intermediate layer (10DA2) and the output layer (10DA3) is corrected by using the error Ea obtained according to the formula (11) (the step 84).

When the error Ea in the formula (11) is differentiated with respect to wa2(j,k) and then rearranged by using the formulae (1)–(5), the change Δwa2(j,k) of the weighing coefficient wa2(j,k) is represented by the formula:

$$\begin{aligned}\Delta wa2(j,k) &= -\alpha\{\delta Ea/\delta wa2(j,k)\} \\ &= -\alpha\cdot\delta a2(k)\cdot ya2(j)\end{aligned} \quad (12)$$

in which α is a parameter representing the learning speed and having an arbitrary value in a range of 0 to 1; and δa2(k) is represented by the following formula.

$$\delta a2(k)=\{ya3(k)-da(k)\}ya3(k)\{1-ya3(k)\}$$

When the change Δwa2(j,k) of the weighing coefficient wa(j,k) is calculated as described above, the weighing coefficient wa(j,k) can be corrected according to the following formula—.

$$wa2(j,k)\leftarrow wa2(j,k)+\Delta wa2(j,k) \quad (13)$$

The weighing coefficient wa1(i,j) 1=1,2,—,N1, j=1,2,—,N2) between the input layer (10DA1) and the intermediate layer (10DA2) is corrected according to the following formulae (14) and (15) in the same manner as described above (the step 85).

First, the change Δwa1(i,j) of the weighing coefficient wa1(i,j) is calculated according to the formula:

$$\Delta wa1(i,j)=-\alpha.\delta a1(j).ya1(i) \quad (14)$$

in which δa1(j) is represented by the following sum formula with respect to k=1—N3.

$$\delta a1(j)=-\Sigma\{\delta a2(k).wa2(j,k).ya2(j)\times[1-ya2(j)]\}$$

The weighing coefficient wa1(i,j) is corrected as represented by the following formula (15) by using the change Δwa1(i,j) obtained according to the formula (14).

$$wa1(i,j) \leftarrow wa1(i,j) + \Delta wa1(i,j) \quad (15)$$

When the correction steps 83-85 on the basis of the n-th learning data are finished as described above, the learning data number n is increased (the step 86) and then the correction steps 83 - 86 are repeated before the perfection of correction based on all learning data is judged ($n > m$) in the step 87.

When correction based on all learning data is finished, corrected weighing coefficients wa1(i,j) and wa2(j,k) are registered in the reversion floor prediction means (10D) (the step 88).

At this time, the learning data used for the correction are all cleared to make it possible to store newest learning data again and then the learning data number m is initialized to "1".

When the network correction procedure (the step 81) for the neural network (10DA) is finished as described above, the network correction procedure (the step 89) for the neural network (10DB) is carried out in the same manner.

As described above, not only a causal relation between the traffic state data at the time of registration of the landing-place call and the predicted reversion floor can be expressed by the networks of the neural networks (10DA) and (10DB) but the networks can be corrected by learning the measured data. Accordingly, the accurate and flexible reversion floor prediction can be realized though it cannot be realized at all in the prior art.

Although the aforementioned embodiment has shown the case where the predicted reversion floors are used for calculation of predicted arrival time, the invention can be applied to the case where the predicted reversion floors may be used for other predictive calculations, for example, prediction of in-cage crowdedness, near-future cage position, cage settlement, etc.

Although the above description has been made on the case where the input data (traffic state data) to the input data conversion means, that is, the input data conversion sub-unit (10CA), include cage position data, running direction data and answerable call data, the traffic state data are not limited thereto. For example, cage state (in speed reduction, in door-opening operation, in open door state, in door-closing operation, in close door and standby state, in running state, etc.) landing- place call duration, cage call duration, cage load, group-control cage number, etc. may be used as input data. In this case, more accurate reversion floor calculation can be made by using these as input data.

Although the above description has been made on the case where the learning data forming means (10F) stores input data and predicted reversion floors at the time of landing-place call assignment and then stores detected reversion floors as true reversion floors when the floors where the direction of the movement of each cage is reversed are detected, to thereby send out the stored input data, the predicted reversion floors and the true reversion floors as a learning data data set, the time of forming such learning data is not limited thereto. For example, learning data may be formed when the time elapsed from the preceding time of input data storage exceeds a predetermined value (for example, 1 minute) or may be formed periodically (for example, every minute). Because the learning condition can be improved as the number of learning data collected under various kinds of conditions increases, representative states considered as a stop state at a predetermined floor, a predetermined cage state (in speed reduction, in stopping, etc.) and the like may be determined in advance so that learning data can be formed when the representative states are detected.

Although the above description has been made on the case where the weighing coefficients in the reversion floor prediction means (10D) are corrected whenever the number of learning data stored in the learning data forming means (10F) reaches a predetermined value, the time of correction of the weighing coefficients is not limited thereto. For example, the weighing coefficients may be corrected whenever learning data are sent out from the learning data forming means (10F). In this case, predicted reversion floors can be calculated with considerable accuracy before the learning is finished. Or the weighing coefficients may be corrected at intervals of a predetermined time (for example, every hour) by using learning data stored for the predetermined time or may be corrected when traffic dwindles so that the frequency in calculation of predicted reversion floors by the reversion floor prediction means (10D) becomes low.

In the aforementioned embodiment, both the upper reversion floor and the lower reversion floor are calculated by the reversion floor prediction means (10D) having neural networks. Accordingly, a learning data set is incomplete if the two data of first and second reversion floors are not present. In this case, a large time is required for obtaining a necessary number of learning data. Accordingly, upon the consideration of this point of view, a neural network for use only in predictive calculation of the upper reversion floor and a neural network for use only in predictive calculation of the lower reversion floor may be separately provided in the reversion floor prediction means (10D). In this case, the time from the point of time of prediction to the point of time when the direction of the movement of the cage is reversed can be shortened on average, so that a greater number of learning data can be collected in a short time.

In the aforementioned embodiment, reversion floors are calculated all day by using the reversion floor prediction means (10D) having neural networks of the same. It is, however, difficult to predict reversion floors flexibly and accurately correspondingly to various kinds of traffic volume by using cage position data, running direction data and answerable call data as input data, because the traffic stream changes momentarily in the day. To solve this difficulty, it is necessary that data representing the characteristic of the traffic stream, such as traffic volume (the number of passengers, the number of landing- place calls, the number of cage calls, etc.) taken statistically in the past, are used as input data. However, as the number of input data increases, not only a larger time is required for predictive calculation of reversion floors but a larger number of learning data and a larger learning period are required for correction of the weighing coefficients of the reversion floor prediction means (10D).

Accordingly, upon the consideration of this point of view, one day may be divided into a plurality of time zones or traffic patterns correspondingly to the characteristic of the traffic stream and, further, a plurality of reversion floor prediction means corresponding to the time zones or traffic patterns may be provided to calculate predicted values of reversion floors by changing over the reversion floor prediction means while detecting the characteristic of the traffic stream. In this case, the number of reversion floor prediction means increases but there is no necessity of use of traffic volume as input data. As a result, in this case, not only the time required for calculation can be shortened but the learning data required for correction of the weighing coefficients can be reduced both in number and in period.

As described above, the elevator control apparatus according to an aspect of the invention comprising: an input data conversion means for converting traffic state data containing cage position data, running direction data and answerable call data into the form of data used as input data to a neural network; a reversion floor prediction means forming the neural network and including an input layer for receiving said input data, an output layer for sending out, as output data, data corresponding to the predicted reversion floors, and an intermediate layer disposed between the input layer and the output layer and having weighing coefficients; and an output data conversion means for converting the output data into the form of data used for a predetermined control operation, by which predicted values of floors where the direction of the movement of the cage is reversed are calculated as predicted reversion floors through fetching traffic state data in the neural network. Accordingly, reversion floors near the true reversion floors can be predicted flexibly corresponding to the traffic state or traffic volume. There arises an effect in that an elevator control apparatus which can improve accuracy in predicted arrival time or the like is provided.

Further, the elevator control apparatus according to another aspect of the invention comprises: a learning data forming means for storing not only the predicted reversion floor of a predetermined cage together with the input data at the time of prediction but the true reversion floor obtained by detecting a floor where the direction of the movement of the predetermined cage is actually reversed, at a predetermined point of time in a running period of the elevator, to thereby send out the stored input data, the predicted reversion floor and the true reversion floor as a learning data set; and a correction means for correcting the weighing coefficients of the reversion floor prediction means by using the learning data forming means, by which the weighing coefficients in the neural network are corrected automatically on the basis of the calculated result of prediction, the traffic state data at that time and the measured data. Accordingly, automatic control can be made though the traffic stream may change according to the change of state in use of the building (for example, the change of tenants). The above mentioned elevator control apparatus provide increased accuracy in prediction of reversion floors.

What is claimed is:

1. An elevator control apparatus comprising:

an input data conversion means for converting traffic state data including elevator cage positions, cage running directions, and calls to be responded, into data in the form usable as input data to a neural network;

means for predicting a reversal floor including a neural network having a least an input layer for receiving input data from said input data conversion means, an output layer for outputting, as output data, data corresponding to the predicted reversal floors at which elevator cages are predicted to reverse their moving directions, and an intermediate layer disposed between said input layer and said output layer which simultaneously processes the neural network data having weighing coefficients, said reversal floor prediction means transmitting data corresponding to the floors at which said elevator cages are predicted to reverse their moving direction, whenever a landing place call is registered;

an output data conversion means for converting the output data into data in a form usable for a predetermined control operation, means for detecting floors at which the cages are actually reversed;

learning data forming means for storing the predicted reversal floors of the cages together with the input data at the time of prediction and the floors at which the cages are actually reversed as learning data at a predetermined point of time in a running period of the elevator;

correction means for correcting the weighing coefficients of said reversal floor prediction means using the learning data; and means for controlling the operation of the cages on the basis of the converted output data.

2. An elevator control apparatus according to claim 1 wherein said reversal floor prediction means includes a plurality of independent neural networks which calculate the predicted reversion floors.

3. An elevator control apparatus according to claim 1 wherein said data corresponding to the predicted reversal floors at which the elevator cages are predicted to reverse their moving directions are related to predicted reversal floors at which the elevator cages are predicted to reverse their moving directions upward and/or downward.

4. An elevator control apparatus according to claim 1 wherein the input data to said input data conversion means include statistical characteristic data of traffic survey.

5. An elevator control apparatus according to claim 4 wherein a traffic volume such as the number of passengers taken according to statistics in the past is used as the statistical characteristic data of traffic survey.

6. An elevator control apparatus according to claim 4 wherein said reversal floor prediction means are provided in plural corresponding to time zones or traffic patterns distributed on the basis of the characteristics of said statistical characteristic data of traffic survey.

7. An elevator control apparatus according to claim 1 wherein the input data to said input data conversion means includes cage state data or call state data.

8. An elevator control apparatus according to claim 1 wherein said apparatus further comprises a predicted arrival time calculation means for calculating the predicted arrival time of said cages on the basis of the data corresponding to the predicted reversion floors at which said elevator cages are predicted to reverse their moving directions.

9. An elevator control apparatus according to claim 8 wherein said predicted arrival time calculation means makes the calculation on the assumption that the elevator cages run successively between a plurality of predicted reversal floors.

10. An elevator control apparatus according to claim 8 wherein said predicted arrival time calculation means calculates the predicted arrival time at landing places above or below the predicted upper or lower reversal floors, on the assumption that the upper or lower landing places are regarded as the predicted reversal floors.

11. An elevator control apparatus according to claim 8 wherein said predicted arrival time calculation means calculates the predicted arrival time on the assumption that the cages having no direction go from the cage-position floors directly to landing places at which calls have been generated.

12. An elevator control apparatus according to claim 8 wherein said apparatus further comprises a group controller for evaluating a waiting time for landing-place calls on the basis of the predicted arrival time calculated by said predicted arrival time calculation means to thereby assign cages the landing-place calls.

13. An elevator control apparatus according to claim 1 wherein said learning data forming means repeats the learning data forming and storing operation at a predetermined point of time or when a predetermined state is detected.

14. An elevator control apparatus according to claim 1 wherein said learning data forming means repeats the learning data forming and storing operation in synchronism with the time of landing-place call assignment.

15. An elevator control apparatus according to claim 1 wherein said learning data forming means sense a reversal in cages moving direction and stores the reversion floors as the true reversal floors.

16. An elevator control apparatus according to claim 1 wherein said correction means performs correction at a preset time or state.

17. An elevator control apparatus according to claim 1 wherein said correction means performs correction when the number of sets of the learning data repeatedly formed and stored reaches a predetermined value.

18. An elevator control apparatus according to claim 1 wherein said correction means performs correction by using the difference between true output data and desired output data.

19. An elevator control apparatus according to claim 1 wherein said correction means performs correction when the frequency in registration of landing-place calls becomes low.

20. An elevator control apparatus according to claim 1 wherein the predicted reversal floors are calculated both in the case where landing-place calls are temporarily assigned to the respective cages and in the case where landing-place calls are not temporarily assigned to the respective cages.

21. An elevator control apparatus according to claim 1 wherein said learning data are formed separately with respect to the cages assigned landing-place calls.

22. An elevator control apparatus according to claim 1 including first and second reversal floor prediction means, said correction means correcting the respective weighing coefficients of said reversal floor prediction means independently of each other.

23. An elevator control apparatus according to claim 1 including first and second reversal floor prediction means for predicting upper reversal floors and lower reversal floors, respectively.

24. An elevator control apparatus according to claim 2 wherein said reversal floor prediction means constitutes a plurality of independent neural networks for calculating reversal floors respectively.

25. An elevator control apparatus according to claim 1 wherein said learning data forming means repeats the learning data forming and storing operation in synchronism with a preset time period.

26. An elevator control apparatus according to claim 1, wherein the input layer, the intermediate layer and the output layer each contain a plurality of nodes.

27. An elevator control apparatus according to claim 26, wherein the number of nodes in the output layer is equal to twice the total number of floors.

28. An elevator control apparatus according to claim 26 wherein the number of nodes in the input and intermediate layers are determined based on factors including the total number of floors in the building, the total number of cages and the type of input data used.

* * * * *

UNITED STATES PATENT AND TRADEMARK OFFICE

CERTIFICATE OF CORRECTION

PATENT NO. : 5,250,766

DATED : October 5, 1993

INVENTOR(S) : Hikita et al.

It is certified that error appears in the above-indentified patent and that said Letters Patent is hereby corrected as shown below:

Col. 17, line 62, change "a" to --at--.
Col. 18, line 10, change "," to --;--.
Col. 18, line 44, change "are" to --is--.
Col. 18, line 54, after "data" insert --transmitted from said reversal floor predicting means--.
Col. 18, line 67, delete "upper or lower".

Signed and Sealed this

Twenty-fifth Day of October, 1994

*Attest:*

Bruce Lehman

BRUCE LEHMAN

*Attesting Officer*

*Commissioner of Patents and Trademarks*